US005329869A

United States Patent [19]

Freeman et al.

[11] Patent Number: 5,329,869

[45] Date of Patent: Jul. 19, 1994

[54] CLOSURE LATCHING MECHANISM

[75] Inventors: Arvie E. Freeman, Ophir; Franz A. Shindler, Gold Beach, both of Oreg.

[73] Assignee: Freeman Marine Equipment, Inc., Gold Beach, Oreg.

[21] Appl. No.: 33,840

[22] Filed: Mar. 19, 1993

[51] Int. Cl.[5] ..... B63B 17/00

[52] U.S. Cl. ..... 114/117; 114/203; 292/51

[58] Field of Search ..... 114/117, 118, 119, 120, 114/201 R, 203, 174, 176, 177, 178; 292/50, 51, 52, 256.5, DIG. 18

[56] References Cited

U.S. PATENT DOCUMENTS

| | | | |
|---|---|---|---|
| 37,849 | 3/1863 | Becker | 114/117 X |
| 1,488,441 | 3/1924 | Sanders | 292/50 |
| 2,271,952 | 2/1942 | Raus | 114/117 X |
| 2,440,764 | 5/1948 | Wilson | 114/117 |
| 2,493,980 | 1/1950 | Lambert | 114/117 X |
| 2,859,470 | 11/1958 | McClung | 292/50 X |
| 3,088,548 | 5/1963 | Behrens et al. | 292/51 X |
| 3,589,759 | 6/1971 | Bercheux | 292/50 |
| 4,020,778 | 5/1977 | Sutton | 114/203 |
| 4,199,176 | 4/1980 | Kelly | 292/50 |
| 4,844,518 | 7/1989 | Pritchard | 292/28 |

FOREIGN PATENT DOCUMENTS

| | | | |
|---|---|---|---|
| 1102003 | 1/1959 | Fed. Rep. of Germany | 292/51 |

*Primary Examiner*—Sherman Basinger
*Attorney, Agent, or Firm*—Klarquist Sparkman Campbell Leigh & Whinston

[57] ABSTRACT

The door, hatch or other closure in a marine vessel includes a large central window, and is manually or mechanically latched or unlatched by a quick-acting actuation mechanism. An outer handle or an inner handle is rotated, thereby pulling a chain that engages each of a plurality of sprockets. As the chain is pulled, each of a plurality of dogs rotate to engage or disengage a corresponding number of strikers attached to a jamb. The position of dog is visually identifiable from the position of the handles.

11 Claims, 4 Drawing Sheets

CLOSURE LATCHING MECHANISM

TECHNICAL FIELD

This invention relates to a mechanism for latching doors, hatches and other closures in ships and related marine applications.

BACKGROUND INFORMATION

Doors and hatches used in ships and analogous vessels often utilize quick-acting latching mechanisms that allow the door or hatch to be latched and unlatched by rotating a single handle. In many cases, the handle actuates a series of rack and pinion gears, ratchet gears, or levers, which in turn simultaneously actuate a series of dogs located around the periphery of the door. The dogs engage cam surfaces on the door frame or coaming, and pull the door against the frame to form a watertight seal between the door and the frame when the door is closed and latched. Such latching mechanisms are advantageous because they allow the door or hatch to be secured and sealed very rapidly.

Regardless of the manner in which the door is latched, it is often desirable in marine applications to provide a window or port hole in the door to increase visibility through the door. For example, in vessels designed for towing, it is advantageous to have a window in the door to the pilot cabin so the operator may observe the vessel being towed. However, if the window is too small, the operator may have to open the door to check, for example, the condition or position of the vessel being towed. Opening the door may be dangerous because it exposes the pilot cabin to the elements. Larger windows are therefore preferred.

Ample visibility through the pilot cabin door is especially important when towing in inclement weather, when the need to leave the door shut is especially important. Large windows in the doors of engine compartments, and in hatches, are advantageous for similar reasons. Visibility through marine closures is also important since the closures are often located in confined spaces, and a large window opening permits viewing through the closure to see if people are in the way of the closure when it is opened. This is particularly true with closures used in yachting and passenger for hire vessels where persons on board a vessel may not be familiar with normal craft procedures.

The size of the windows in existing marine doors and hatches has been necessarily limited because their latching mechanisms are typically complex, utilizing a system of bulky gears or levers, or other custom mechanisms, which may extend into and thus obstruct the central portion of the door or hatch where the window would be located. Thus, many prior gear-driven or lever-driven latching mechanisms are incompatible with doors having a large central window.

In addition, gear-activated latching mechanisms may be incompatible with anything but square or rectangular doors, and cannot be made to easily accommodate odd, or irregular shaped doors or hatches.

U.S. Pat. No. 2,271,952 discloses a quick-acting, watertight ship door, which utilizes a system of rotatable dogs actuated by a series of rack and pinion gear elements contained within the interior of the door. This mechanism is complicated and unwieldy. In addition, the gear mechanisms are subject to malfunction when fouled by corrosion or when worn.

Other types of latching mechanisms are not adaptable to be used in harsh marine environments. For example, U.S. Pat. No. 4,844,518 discloses, in one embodiment, a chain-and-sprocket mechanism for actuating a plurality of hinged catch latches for sealing a lid on a container. This kind of a latch system is unsuitable for use in a marine environment because, among other reasons, the latch system is not secure enough to withstand the severe environmental stresses present in marine applications. Further, the chain is tensioned by a spring-loaded tensioning device positioned in the central portion of the container lid. This precludes use of the device in a door or hatch having a central window opening.

Thus, there is a need for a quick-acting latching mechanism for marine doors, hatches and other closures, which is adapted for use in harsh marine environments, which may be used in a door having a large window opening, and which may be used in any shape of door or hatch.

SUMMARY OF THE INVENTION

This invention relates to a mechanism for latching a marine door or hatch. The mechanism includes a plurality of rotatable dogs positioned around the periphery of the door, and manually actuated by rotation of a single handle. In a preferred embodiment, the handle pulls an endless chain that engages a sprocket connected to each dog.

The latching mechanism is confined to the outer peripheral portion of the door or hatch, leaving a substantial percentage of the surface area of the door or hatch open for inclusion of a large window or porthole. The mechanism is adaptable for use with any number of door or hatch shapes.

DESCRIPTION OF THE PREFERRED EMBODIMENTS

Figure 1:
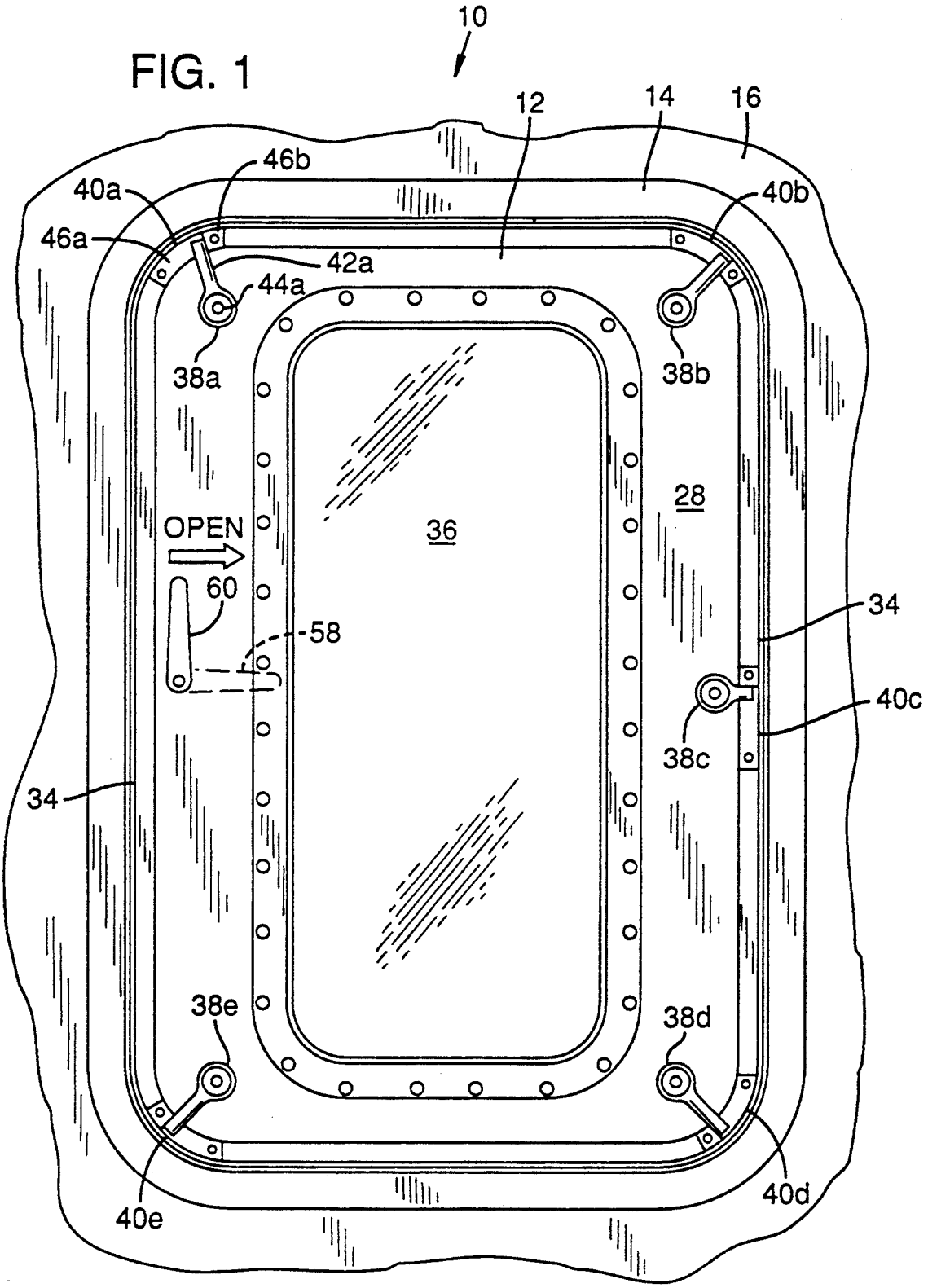
FIG. 1 is a plan view of the inside of a marine door utilizing the closure mechanism of the present invention.
Figure 2:
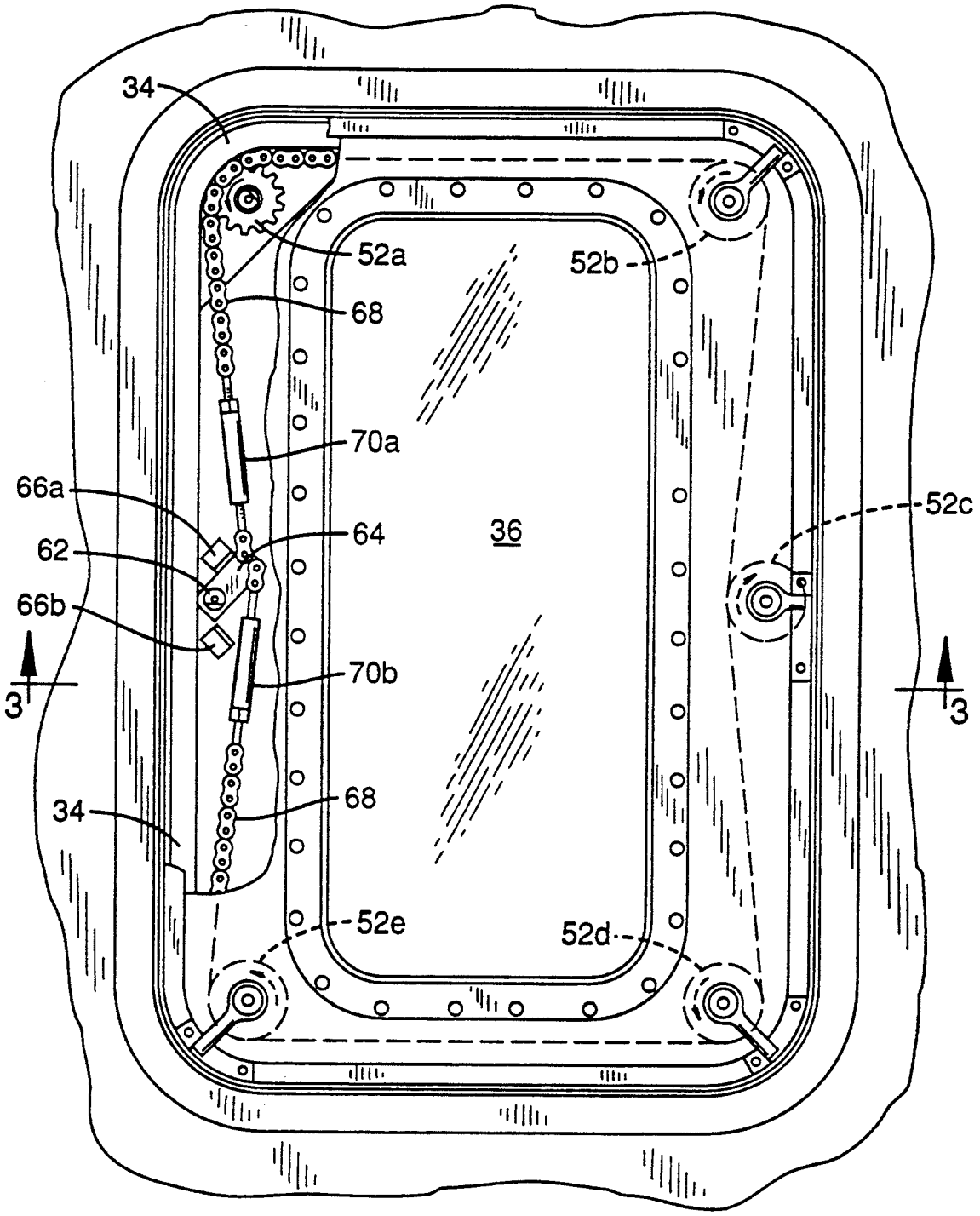
FIG. 2 is a plan view similar to FIG. 1, with an edge portion of the inside door panel cut away to reveal the chain-operated latching mechanism.
Figure 3:
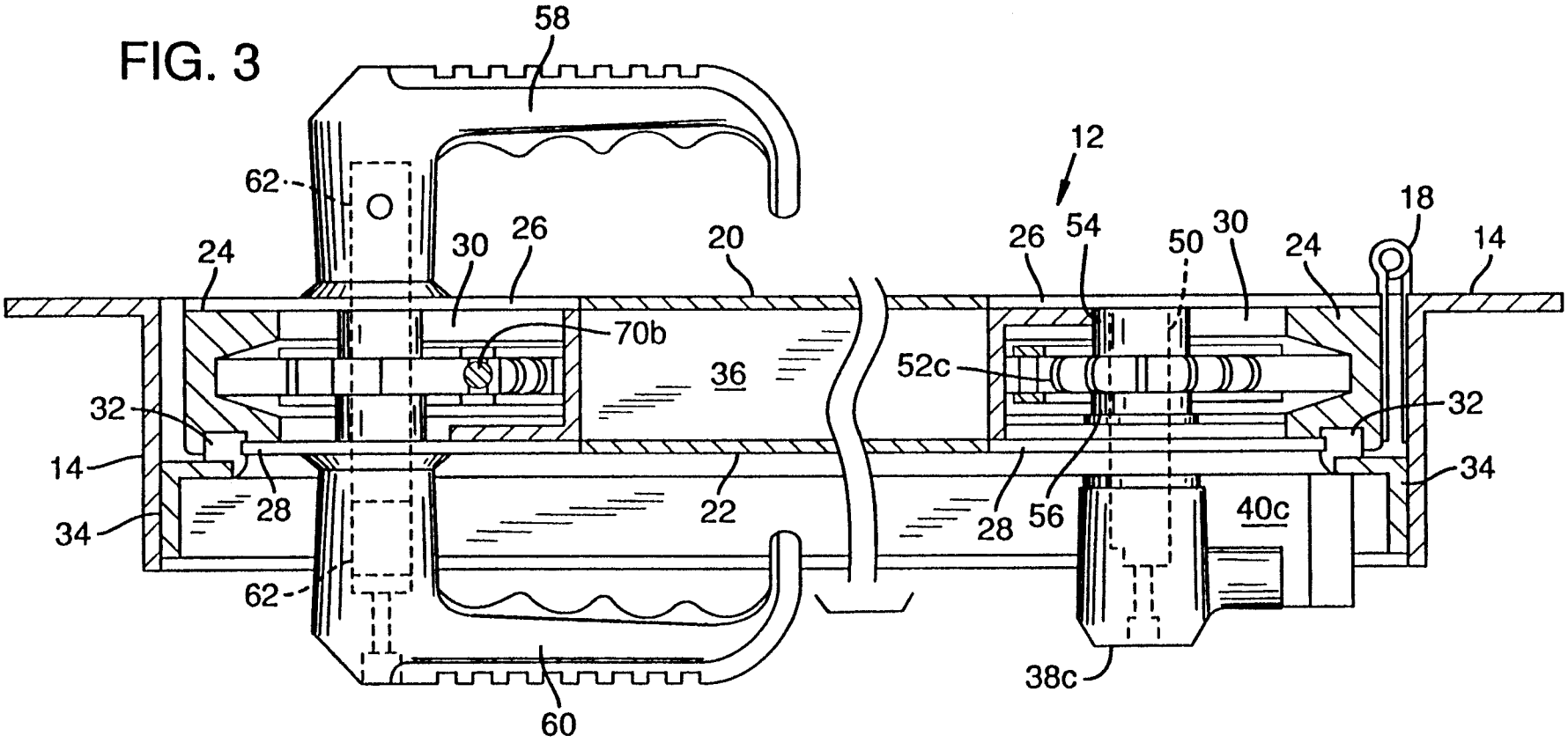
FIG. 3 is an enlarged and foreshortened sectional view of the door closure taken along the line 3—3 of FIG. 2.

FIGS. 1, 2 and 3 illustrate one embodiment of a door assembly 10 incorporating the quick-acting latching mechanism of the present invention.

Door and Frame

The door 12 illustrated in FIGS. 1, 2 and 3 is generally rectangular in shape, having opposite parallel lateral edges, opposite parallel top and bottom edges, and generally rounded corners. The door corresponds to, and functions as a closure for, an opening in a wall or bulkhead 16. A door frame member 14 surrounds and defines the opening in bulkhead 16, and door 12 is sized to provide a closure for the opening. Door 12 is hinged to frame member 14 in a conventional manner (the hinges, one which is illustrated in FIG. 3 as numeral 18, are located on the outer side of the door). However, the hinges are optional, and the latching mechanism of the present invention performs equally well with removable doors. Door 12 may be of any dimension, and as discussed below, a wide variety of shapes.

Door 12 has an outer side 20 and an inner side 22 (FIG. 3). A rigid peripheral door frame member 24 extends around the entire outer margin of door 12 to form the peripheral limits of the door. An outer panel 26 is attached to the outside of frame member 24 to define the outer surface of door 12. Similarly, an inner panel 28 is attached to the inside of frame member 24 to define the inner surface of door 12. Frame member 24 is therefore sandwiched between outer panel 26 and inner panel 28, defining a hollow inner core space 30 between outer panel 26 and inner panel 28 with outer limits defined by frame member 24.

A gasket 32 extends around the inner margin of door 12 where the door hits a jamb 34 connected to frame 14 when door 12 is closed. When the door is closed and latched, gasket 32 seats against jamb 34 to form a snug, watertight seal. Alternatively, gasket 32 may be attached to, and extend around jamb 34 in a position to contact door 12 when it is closed. Gasket 32 is formed of a resilient material, such as rubber, capable of forming the required seal.

As illustrated in FIG. 1, which shows inner side 22 of the door, door 12 includes a large central window 36 through the inside and outside door panels 26, 28, that occupies a substantial percentage of the surface area of the door. Window 36, which is rectangular in FIGS. 1-3, but which may be of any shape, is fitted into door 12 through core 30 in a conventional manner for windows or portholes used in marine environments.

Doors incorporating the latching mechanism of the present invention may be utilized in any location in a ship or analogous vessel where a marine closure is required.

Latching Mechanism

A series of rotatable latching dogs 38*a*, 38*b*, 38*c*, 38*d* and 38*e* are located at spaced intervals about the peripheral inside edge portion of door 12, and extend outwardly from surface 28. A corresponding number of cooperative striker plates 40*a*, 40*b*, 40*c*, 40*d* and 40*e* are attached to door jamb 34. A striker 40 is attached to jamb 34 in a position to correspond to and engage each dog 38 when the door is latched. Generally, to provide for a snug closure between the door and frame, there is a dog and a corresponding striker located in each corner of the door or hatch. In addition, depending upon the size and shape of the door, additional dogs and strikers may be added to provide a sufficient seal when the door is latched. Thus, in FIG. 1, which shows a rectangular door, there are five dogs and strikers, one in each of the four corners, and one on the one lateral side edge of the door. The precise number of dogs and strikers is not critical so long as a sufficient number are provided to form a watertight seal when the door is closed and latched.

Each dog 38 is similar in structure to the other dogs, with the only difference between dogs being the relative length of an elongated latching arm portion 42. Thus, referring for example to dog 38*a*, the dog comprises an elongated arm portion 42*a* extending from a generally circular base 44*a*. In FIG. 1, dogs 38*a*, 38*b*, 38*d* and 38*e* are located each at one corner of door 12. Dog 38*c* is located along the side edge of door 12. The arm portion 42 of dogs 38*a*, 38*b*, 38*d* and 38*e* is longer than the arm portion 42 of dog 38*c* to allow for the arm portion of the dogs located in the corners to span the greater distance between the dogs and the strikers in the corners of the frame.

Each striker 40 is conventional in structure. Thus, referring to striker 40*a*, the striker includes an inclined camming surface portion 46*a*, and a striker stop 46*b* located at one end of the camming surface portion 46*a*. Strikers 40*a*, 40*b*, 40*d* and 40*e* are located each in one corner of frame 14, which is rounded at the corners, and are therefore arcuate in shape. By rotating latching arm 42*a* over camming surface 46*a*, the door is urged tightly against the jamb.

As seen in FIG. 3, which illustrates a typical dog 38*c*, dog 38*c* is attached to one end of a dog spindle 50. The opposite end of dog spindle 50 protrudes through outside door panel 26, and is journaled to outer panel 26 so that spindle 50 is rotatable. A sprocket wheel 52 is keyed to each dog spindle 50 so that rotation of spindle 50 rotates sprocket 52. Alternatively, spindle 50 may be non-circular in cross section to prevent rotation of sprocket 52 on spindle 50. An outer bearing block 54 and an inner bearing block 56 surround spindle 50 on either side of sprocket 52 within core space 30, and hold the sprocket 52 in a fixed position in the center of core space 30. Thrust bearings (not shown) may be placed between the bearing blocks and the sprocket.

Spindle 50 may also be fixed within core space 30 such that only one end of the spindle protrudes through panel 28. In this case, the opposite end of spindle 50 is not connected to panel 26.

In the preferred embodiment shown in FIGS. 1 through 3, sprockets 52*a*, 52*b*, 52*d* and 52*e* are located one in each of the four corners of door 12 (FIG. 2). Sprocket 52*c* is located along the lateral peripheral side edge of door 12. The location of the sprockets within the door is not critical so long as the number of sprockets and associated dogs is sufficient to provide a tight, fluid seal between the closure and the jamb. Thus, depending upon the size and shape of the closure, the sprockets may be located in various positions around the periphery of the door.

The dogs are actuated by rotation of an elongated outer handle 58, or an elongated inner handle 60 (FIG. 3). The handles illustrated in FIGS. 1 through 3 are fixed to the opposite ends of a common handle shaft 62 that extends through door 12, and protrudes through outer panel 26 and inner panel 28. Both handles are fixed to shaft 62, which is rotatable, so that rotation of either handle in either the clockwise or counterclockwise direction causes shaft 62 and the handle on the opposite side of the door to rotate in the same direction. In FIG. 3, the elongated portion of outer handle 58 and inner handle 60 extend in the same direction. However, the relationship between the inner and outer handles is not critical, and they may be offset, as illustrated by the dashed lines in FIG. 1. In addition, the handles may be removable from the handle shaft.

As illustrated in FIG. 2, which shows a portion of inside panel 26 removed, a cam arm 64 is attached to, and extends from shaft 62 within core 30. Cam arm 64 is fixed to shaft 62 so that rotation of the shaft 62 causes cam arm 64 to rotate.

Shaft 62 is rotated by turning either outer handle 58 or inner handle 60. This rotation of shaft 62 causes cam arm 64 to rotate in the same clockwise or counterclockwise direction that the handle is rotated. The arc through which the handle and shaft 62 may be rotated is limited by a pair of cam arm stops 66*a*, 66*b*, which are positioned one on each side of shaft 62, within core 30. Thus, handle 58 or 60 may be rotated until cam arm 64 abuts one of the cam arm stops 66*a* or 66*b*. In the preferred embodiment, the cam arm stops 66 are set in positions that allow the handles to rotate about 90°.

In FIG. 2, cam arm 64 is illustrated abutting against cam arm stop 66*a*. Rotation of inner handle 60 in the clockwise direction in FIG. 2 could continue through an arc of about 90° or until cam arm 64 abuts against cam arm stop 66*b*. The arc of rotation of handles 58, 60 may be increased by increasing the angle between the cam arm stops 66. Similarly, the arc of rotation of the handles may be decreased by decreasing the angle between the cam arm stops.

Returning to FIG. 2, a chain 68 extends around the periphery of door 12 to engage each sprocket 52. One end of chain 68 is connected to one side of cam arm 64 outwardly from where the cam arm is attached to shaft 62, near the outermost end of the cam arm. The other end of chain 68 is connected to the opposite side of cam arm 64, opposite the position where the other end of chain 68 is attached to cam arm 64.

A pair of turnbuckles 70*a* and 70*b* are added in-line to chain 68, one near each of the opposite ends of the chain to provide adjustable chain tension.

Chain 68 extends around the outer side of the corner sprockets 52*a*, 52*b*, 52*d* and 52*e*, between these corner sprockets and frame member 24. Thus, chain 68 engages the teeth on the outside of the corner sprockets 52. In the preferred embodiment, chain 68 engages the teeth on the inner side of sprocket 52*c*, which is located on the lateral peripheral side of door 12, opposite the handles. Thus, as noted in FIG. 2, chain 68 extends around the inner side of sprocket 52*c*, between the sprocket and window 36. This configuration provides for positive engagement of the chain to the sprocket teeth.

Alternatively, cam arm 64 may be replaced by a sprocket wheel (not shown) that is connected to the shaft handle with either a key, or for example, a non-circular shaft. When a sprocket replaces cam arm 64, chain 68, which is endless with an in-line turnbuckle, engages one side of the toothed sprocket. As the handle is rotated, the toothed sprocket rotates in the same clockwise or counterclockwise direction, causing the chain to move each of the sprockets and dogs. Stops connected to either the handle or the sprocket limit the arc of rotation through which the handle may rotate. Alternatively, handle rotation may be stopped by the dogs' contact with the striker stops.

In the preferred embodiment shown in FIGS. 1 through 3, the sprockets and dogs are located within the door, and the strikers are located in corresponding positions on the frame. However, the orientation of the strikers relative to the sprockets and dogs could be reversed. That is, the sprockets and dogs could be located on the frame, and the strikers positioned around the door. In that case, the dogs, which are keyed to dog spindles and sprockets as detailed above, are actuated by a chain that extends around the frame, generally within the wall. The chain is actuated by moving either an inner or an outer handle on the wall, which rotates the dogs to either engage or disengage strikers on the door in positions corresponding to the positions of the dogs.

Operation

The quick-acting, chain-driven latching mechanism actuates simultaneously each dog 38, causing the dogs to either engage (i.e., latch), or disengage (i.e., unlatch) the corresponding strikers 40. Door 12 may be latched or unlatched quickly by rotation of either outer handle 58 or inner handle 60. In FIG. 1, with door 12 in the closed and latched position, the elongated portion of handle 60 extends in the vertical direction. In this position, each dog 38 bears against the inclined camming surface portion 46 of each striker, urging door 12 in a transverse direction toward jamb 34, and seating gasket 32 firmly against the jamb. This creates a snug, fluid seal between door 12 and jamb 34.

With door 12 in the closed and fully latched position, cam arm 64 abuts cam stop 66*a* (FIG. 2). Rotation of handle 60 in the opening direction (clockwise in FIGS. 1 and 2), begins rotation of cam arm 64 in the clockwise direction, pulling chain 68 in the same direction. Each sprocket 52, and each dog 38 connected to the sprocket by dog spindle 50, rotates simultaneously in the direction dictated by the relationship of the chain engagement to the sprocket, as explained below, and as illustrated with arrows. In the preferred embodiment, each sprocket 52 has the same diameter. Thus, each dog rotates at the same rate of rotation, which in the preferred embodiment is equal to the rate of rotation of the handle.

Rotation of handle 60 causes a corresponding movement, or shift, of chain 68. Movement of handle 60 through the full range of motion, dictated by the positions of cam arm stops 66*a*, 66*b*, shifts chain 68 a distance roughly equivalent to the distance between the position of the outermost end of cam arm 64 when it abuts cam stop 66*a*, and the position of the outermost end of cam arm 64 when it abuts cam stop 66*b*.

The direction that the individual dogs rotate when a handle is rotated depends upon the clockwise/counterclockwise direction that the handle is rotated, and also upon the orientation of the chain relative to the sprocket. Thus, the orientation of the chain to the sprockets discussed above causes the direction of rotation of sprocket 52*c*, which is located on the side of door 12, to be opposite that of the corner sprockets 52*a*, 52*b*, 52*d* and 52*e*. Specifically, the direction of rotation of dogs 38 when handle 60 is rotated from the latched position (handle 60 extending in the vertical direction; solid lines) to the unlatched position (handle 60 extending in the horizontal direction; dashed lines) is illustrated with arrows in FIG. 1. In this instance, with the chain oriented on the sprockets as indicated in FIG. 2, dogs 38*a*, 38*b*, 38*d* and 38*e* rotate in one direction (counterclockwise), while dog 38*d* rotates in the opposite direction (clockwise), when the handle is rotated in the clockwise direction.

When handle 60 is fully rotated, that is, when cam arm 64 abuts against and stops at cam stop 66*b*, each dog fully disengages the corresponding striker, unlatching the Latching the door is accomplished in an identical manner, but by closing the door and rotating the handle in the opposite direction to cause the dogs to engage the strikers.

The strikers 40 corresponding to the dogs are oriented so that the striker stops 48 are in a position such that the arm portion of each dog first contacts the camming surface portion of the strikers as the dog rotates to engage the striker, and to stop the rotation of the dogs when the handle is fully rotated (i.e., when cam arm 64 abuts the opposite cam arm stop 66*a* or 66*b*), and the door is latched.

The direction that the handle rotates to engage the dogs to the strikers may be reversed to allow use of the latching mechanism with either right-handed, or left-handed opening doors, or to otherwise accommodate specific applications. Thus, the direction that the chain-driven sprockets rotate the dogs to engage the strikers may be reversed from clockwise to disengage the dogs from the strikers (as illustrated in FIGS. 1 through 3), to counterclockwise rotation to disengage the dogs from the strikers (not shown). In the latter case, the orientation of the strikers must be reversed so that the striker stops are located on the opposite end of the strikers to stop the dogs when they rotate in the opposite direction.

Rotation of either handle 58 or 60 causes chain 68 to shift, and simultaneously rotates each dog spindle 50 and therefore the sprocket and its connected each dog 38 in an identical manner. In other words, the chain and dogs are timed in a 1:1 sprocket ratio such that rotation of either handle 58 or 60 causes rotation of handle shaft 62, and the corresponding rotation of each dog 38 at the same rate. Increasing or decreasing the rate of handle rotation causes a corresponding increase or decrease in the rate of rotation of the dogs.

The rate of rotation of the sprockets relative to the rate of rotation of the handle may be altered by altering the gear ratios between the chain and the sprockets, for example, by changing the diameters of the sprockets. The rate of rotation of individual sprockets relative to other sprockets may similarly be altered by varying the diameters of the sprockets relative to one another. Thus, the rate of sprocket rotation may be either greater or less than the rate at which the handle is rotated.

In addition, the position of either outer handle 58 or inner handle 60 correlates directly to the position of the dogs. Thus, in the preferred embodiment, when the handle is in the vertically upright position (i.e., latched), the dogs will also be in the latched position (i.e., the position in which the dogs fully engage the strikers). Thus, the position of the dogs relative to the strikers corresponds directly to the position of the handle. When the handle is in an intermediate position (i.e., cam arm 64 between cam arm stops 66*a*, 66*b*), the dogs will similarly be in an intermediate position in their arc of rotation. When the handle is in the horizontal position (i.e., unlatched), the dogs also will be in the fully unlatched position (i.e., allowing the door to be opened or closed). This timing allows the position of the dogging mechanism to be visually obvious and verified by observing the position of the handle, even from the outside of the door. Therefore, a person standing outside the door may readily identify the position of the dogs (which are located on the inside of the door) by visually checking the position of the outer handle. The actual orientation of the handle when the dogs are in the fully latched position will vary according to user preference; however, in all instances the handle position is timed to the position of the dogs.

The latching mechanism of the present invention, including sprockets 52 that drive dogs 38, is confined to the peripheral portion of door 12, leaving a substantial portion of the center area of the door available for a window or mechanical attachments such as pantograph hinge mechanisms, yolk style hinge mechanisms, or other mechanical attachments that are suited for placement in the center portion of the closure. For convenience, such mechanisms are hereafter collectively referred to as "windows". The only limitation on the size of the central window is the distance that the sprocket latching system extends toward the center of the door. Turnbuckles attached directly to the chain provide the mechanism for tensioning the chain if it becomes loosened, yet keep the central portion of the door free for placement of a window.

The latching mechanism of the present invention may be manually actuated, as explained above, or actuated mechanically, for example by hydraulics, pneumatics or electrically. Mechanical actuation is accomplished by addition of conventional remotely controlled actuation mechanisms.

The latching mechanism of the present invention may also be utilized with closures designed to be opened from one side only. Thus, only one handle would be provided, either on the inner side of the closure, or on the outer side of the closure. With the exception of the single handle, the latching mechanism would be identical to that described.

Pressure Relief

In some marine applications it is possible for pressure to build up on one side of a closed door. When the pressure differential across the closure becomes great enough, it may be unsafe to unlatch the door rapidly because rapid equalization of the pressure across the door when the fluid seal between the door and the jam is broken may force the door open rapidly.

Accordingly, it is advantageous in such circumstances to include a pressure relieving mechanism in the latching mechanism. Such a pressure relieving mechanism according to the present invention comprises at least one pressure relief dog that is timed such that when each of the other latching dogs are in the fully unlatched position, the pressure relief dog is still in an intermediate position where it partially engages its corresponding striker. That is, the pressure relief dog still partially engages the camming surface portion of its corresponding striker when the handle has been rotated sufficiently to disengage each of the other latching dogs from their corresponding strikers.

In operation, a closure that utilizes a pressure relief mechanism is movable to three positions: the closed or latched position in which there is a fluid seal between the closure and the jamb, an intermediate position wherein the fluid seal is broken but the closure may not be fully opened; and the fully opened position. In the first position, or fully latched position, the handle is rotated to begin rotation of each dog, including the pressure relief dog. Each of the dogs, with the exception of the pressure relief dog, simultaneously disengage their corresponding strikers. At this point the structure of the pressure relief dog and its corresponding striker allow the closure to be opened slightly, sufficient to break the fluid seal between the closure and the jamb, and allowing pressure across the closure to equalize. Continued rotation of the handle rotates the pressure relief dog into the fully unlatched position, and allows the closure to be completely opened.

The pressure relief dog is timed so that it still engages or partially engages its corresponding striker when the remaining dogs are in the fully unlatched position. This timing may be accomplished in several ways, for example by utilizing differing gear ratios for the latching dogs and the pressure relief dog. Thus, the pressure relief dog could be fitted with a sprocket having a larger diameter than the remaining latching dogs, so that the pressure relief dog rotates at a slower rate than the other latching dogs.

Another example of the timing of the pressure relief dog is illustrated in the embodiment of FIG. 2. There, dogs 38*a*, 38*b*, 38*d* and 38*e*, which are located in the corner portions of door 12, function as the pressure relief dogs. The latching arm portions 42 of dogs 38*a*, 38*b*, 38*d* and 38*e* are longer than the latching arm portion 42 of dog 38*c*. Thus, the distal end of latching arm 42 of dog 38*c* disengages from its corresponding striker before the distal end of the other dogs. As such, in the embodiment of FIG. 2, as handle 60 is rotated from the fully latched to the fully unlatched position, dog 38*c*, which is shorter than the remaining dogs, fully disengages from striker 40*c* (i.e., unlatches) before the dogs 38*a*, 38*b*, 38*d*, and 38*e* fully disengage from their corresponding strikers. In this intermediate position with dog 38*c* fully disengaged from striker 40*c*, the fluid seal between door 12 and frame 14 is broken, and pressure may be relieved across the door. However, the door may not be opened because dogs 38*a*, 38*b*, 38*d* and 38*e* still partially engage their corresponding strikers. As handle 60 is further rotated into the fully open position, the remaining dogs fully disengage from their corresponding strikers, and the door may be opened.

Alternative Embodiment

Figure 4:
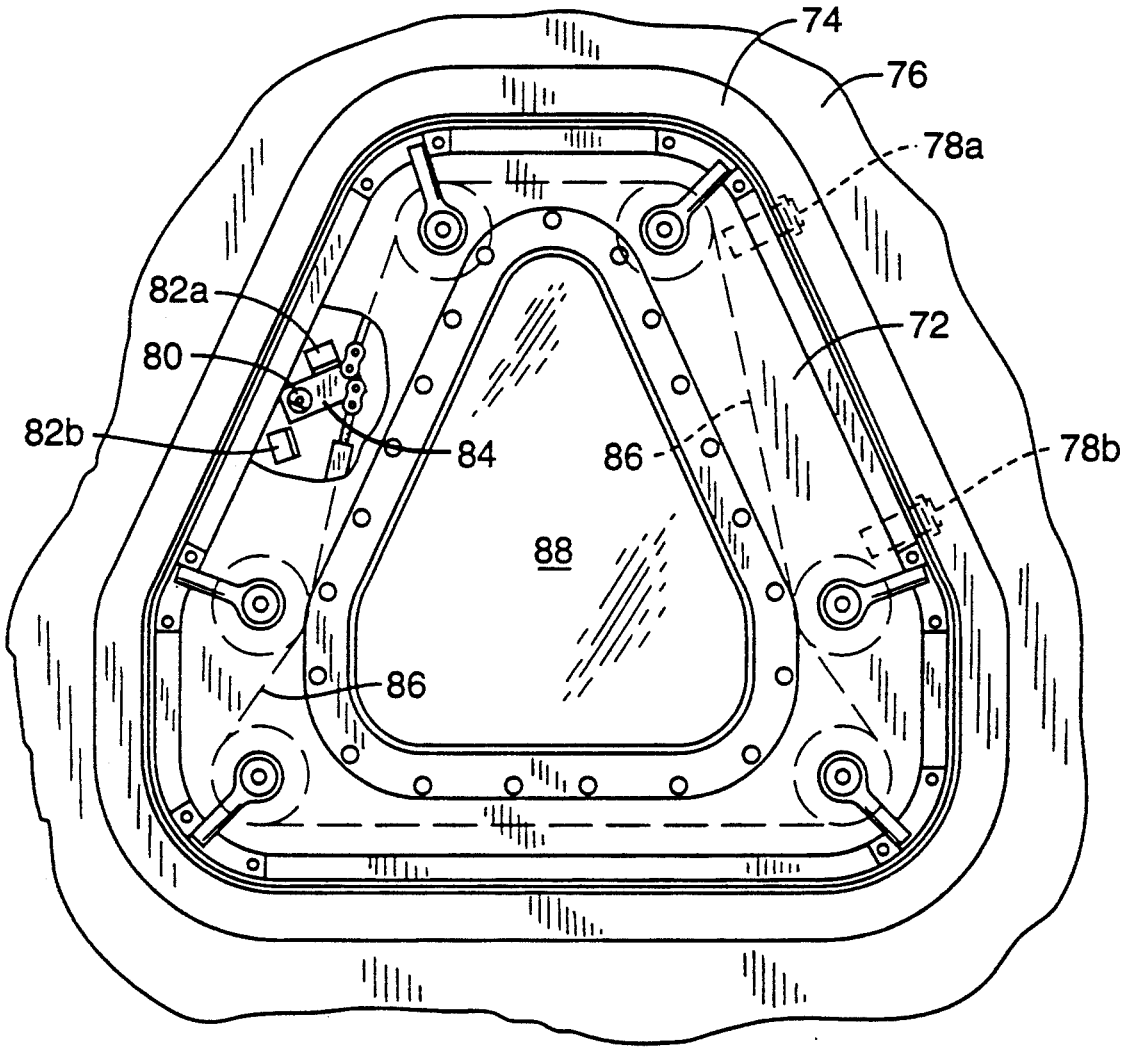
FIG. 4 is a plan view of the inside of a generally triangular shaped hatch that utilizes the latch mechanism of the present invention, including an edge portion of the inside hatch panel cut away to reveal the chain-operated latching mechanism.

The latching mechanism of the present invention may be utilized with doors, hatches, windows and other closures of many shapes. Thus, the latching mechanism is adaptable for use with polygonal closures, or circular or oval closures, or other irregular shaped closures. For example, FIG. 4 illustrates a generally triangular hatch 72 using the latching mechanism of the present invention. The hatch 72 may be removable, or as illustrated in FIG. 4, hinged to a coaming 74 in a bulkhead 76 with hinges 78*a*, 78*b*.

The latching mechanism shown in FIG. 4 with hatch 72 operates in an identical manner as described above with reference to hinged door 12. Thus, an outer and inner handle (not shown) are attached to a handle shaft 80. Rotation of the handles is limited by the positions of cam arm stops 82*a*, 82*b*, which are fixed within the core of the hatch, and which are positioned to stop a cam arm 84 that is attached to handle shaft 80. A chain 86, tensionable with turnbuckles (not shown), extends around the periphery of the hatch to engage a series of sprockets, each of which is directly attached to a dog with a dog spindle, as detailed above with reference to the preferred embodiment. A series of strikers are located around the coaming in positions to engage the dogs when the hatch is closed.

The hatch includes a large central window 88 that occupies a substantial percentage of the surface area of hatch 72, made possible by the efficient utilization of the space within the hatch. In addition, the latching mechanism easily adapts to the irregular shape of hatch 72, and provides a fluid seal between the hatch and coaming when latched, regardless of the shape.

While the present invention has been described in accordance with preferred embodiments, it is to be understood that certain substitutions and alterations may be made thereto without departing from the spirit and scope of the claims.

We claim:

1. A marine closure such as a door or hatch cover, comprising:

a peripheral closure frame;

inner and outer closure panels covering the frame to define a hollow core;

a plurality of latching dogs spaced about a peripheral portion of the closure;

latching dog actuating means mounted within the core and extending about the periphery of the core and operably connected to all of the dogs for actuating all of the dogs simultaneously, the actuating means including one handle operably connected to the plurality of latching dogs, wherein rotation of the handle causes rotation of all of the latching dogs and wherein the distal end of at least one of the dogs rotates at a different rate than the distal ends of the remaining dogs when the handle is rotated; and a large window through the closure occupying a major central area of the closure inwardly of the actuating means.

2. The marine closure according to claim 1, wherein the actuation means includes a plurality of sprockets in the core, one connected to each latching dog, and a chain operably engaging each sprocket and having its terminal ends connected to the handle.

3. The marine closure according to claim 2, including adjustment means for increasing or decreasing the tension on the chain.

4. The marine closure according to claim 1, wherein each latching dog includes an elongated latching arm, and the position of the latching arm is timed to correspond to the position of the handle.

5. The marine closure according to claim 1, wherein the rate of rotation of the dogs is equal to the rate of rotation of the handle.

6. A marine closure such as a door or hatch for opening or closing a void in a wall, comprising:

a closure member moveable between a fully closed position for forming a fluid seal between the wall and the closure member and a fully open position for opening the closure;

multiple latching dogs moveable between a fully latched position for latching the closure in its fully closed position and a fully unlatched position for enabling opening the closure;

common latching dog actuating means common to all the latching dogs for moving the latching dogs between their latched positions and their unlatched positions, the common actuating means being cooperable with all the latching dogs for moving at least one latching dog into its unlatched position more quickly than the other such that when said one latching dog first reaches its fully unlatched position another latching dog is still between its fully latched and fully unlatched positions to break the fluid seal between the wall and the closure, but prevent opening the closure.

7. The marine closure according to claim 6, wherein the actuation means includes a handle operatively connected to each latching dog and operable for moving each latching dog.

8. The marine closure according to claim 7, wherein each dog rotates in response to rotation of the handle.

9. A marine closure latching apparatus, comprising:

a closure element having a large central window through the closure occupying a major central area of the closure;

a frame defining an opening in a wall;

multiple latching dogs adjacent the frame and operable to move between a first position for engaging the closure to the frame to form a fluid seal between the frame and the closure, and a second position to release the closure from the frame to break the fluid seal;

latching dogs actuator interconnecting each latching dog and operable for moving each latching dog between the first and second positions, at least one latching dog operable for moving between the first and second positions more quickly than the other latching dogs.

10. The latching apparatus according to claim 9, wherein the actuator includes a rotatable handle for moving the latching dogs between the first and second positions.

11. The latching apparatus according to claim 9, wherein the distal end of the at least one latching dog disengages from the frame before the other latching dogs.

* * * * *